United States Patent [19]

Küpper

[11] 4,429,842

[45] Feb. 7, 1984

[54] CENTRAL CONNECTIBLE YARN BRAKE MECHANISM

[75] Inventor: Wilhelm Küpper, Wegberg, Fed. Rep. of Germany

[73] Assignee: W. Schlafhorst & Co., Monchen-Gladbach, Fed. Rep. of Germany

[21] Appl. No.: 442,900

[22] Filed: Nov. 19, 1982

[30] Foreign Application Priority Data

Nov. 20, 1981 [DE] Fed. Rep. of Germany ..... 3145990

[51] Int. Cl.[3] ..... B65H 59/22

[52] U.S. Cl. ..... 242/149; 242/129.8; 242/131

[58] Field of Search ..... 242/149, 150 R, 151, 242/152, 152.1, 153, 154, 147 R, 131, 131.1, 129.8; 28/190, 193, 194

[56] References Cited

U.S. PATENT DOCUMENTS

| | | | |
|---|---|---|---|
| 1,790,553 | 1/1931 | Peterson | 242/131.1 X |
| 1,940,476 | 12/1933 | Abbott | 242/150 R X |
| 1,940,477 | 12/1933 | Abbott | 242/150 R X |
| 2,133,507 | 10/1938 | Guild | 242/150 R X |
| 2,537,476 | 1/1951 | Moessinger | 242/149 |
| 3,340,903 | 9/1967 | Golobart | 242/149 X |
| 3,348,582 | 10/1967 | Brookshire | 242/149 X |
| 3,459,389 | 8/1969 | Wildi et al. | 242/150 R |
| 3,633,711 | 1/1972 | Pfarrwaller | 242/149 X |
| 4,272,038 | 6/1981 | Wildi | 242/150 R |
| 4,378,096 | 3/1983 | Schnegg | 242/149 |

FOREIGN PATENT DOCUMENTS 2362481 6/1975 Fed. Rep. of Germany ... 242/150 R

*Primary Examiner*—Stanley N. Gilreath

*Attorney, Agent, or Firm*—Herbert L. Lerner; Laurence A. Greenberg

[57] ABSTRACT

Central connectible yarn brake mechanism for doffed threads from a creel, including a profiled metal bar having at least one groove formed therein, stationary first brake elements being mutually spaced apart along the metal bar outside the groove and each being associated with one of the threads, a first device for individually connecting the first brake elements to the metal bar, movable second brake elements each being associated with one of the threads and being movable between a braking position in which the second brake elements are biased against a thread and against a respective one of the first brake elements and a detached position in which the second brake elements are lifted from a respective one of the first brake elements, bearings disposed on the metal bar in the groove, a central rotatable bar movable in the bearings in the groove, levers each being fastened to the rotatable bar, and a second device for individually connecting each of the levers to a respective one of the second brake elements for holding the second brake elements and moving the second brake elements between the braking and detached positions, at least one of the connecting means being an elastically deformable connection element.

1 Claim, 2 Drawing Figures

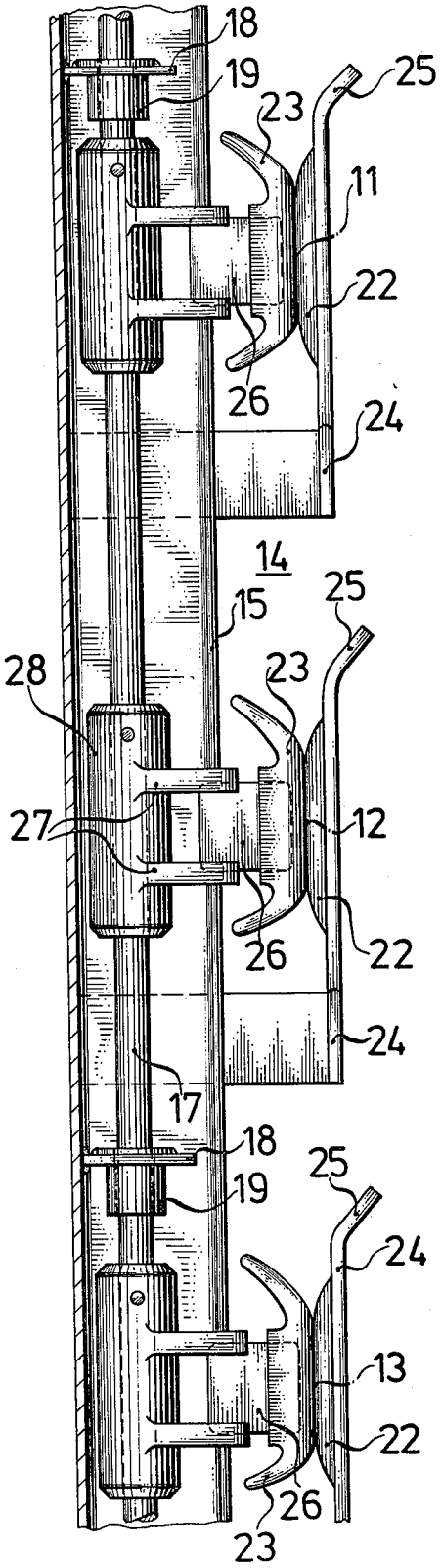
FIG. 1
FIG. 2
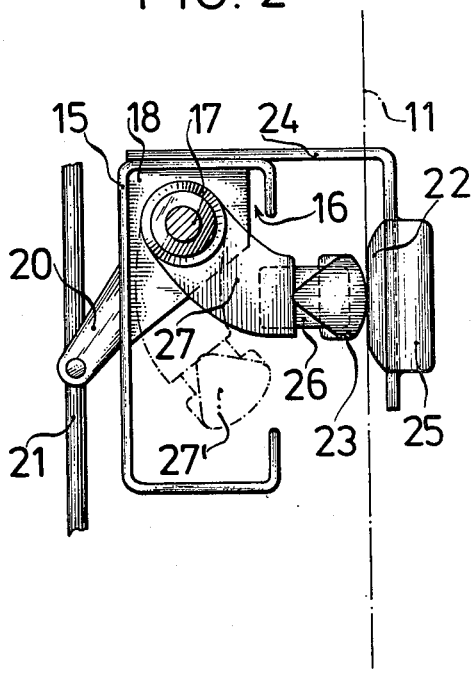

CENTRAL CONNECTIBLE YARN BRAKE MECHANISM

The invention relates to a central connectible yarn brake mechanism including a stationary first yarn brake element and a movable attached second yarn brake element for each thread, the second yarn brake element being lifted from the first yarn brake element in a detached position and being spring biased against a thread and against the first yarn brake element in a braking position.

For winding up doffed threads from a creel to a beam or the like, high winding speeds should be maintained. At full winding operation, it is therefore harmful for the threads to be braked further. For this reason, yarn brakes are used which are only effective at a standstill or at low winding speeds. Because of the use of high doffing speeds, the yarn brakes are taken out of operation.

For this operation, controllable yarn brakes are known, which work with brake shoes that operate with diverse bearings over joints and longitudinal guides. Such joints and bearings are also situated close to the yarn path, where the danger exists of them becoming dusty and soiled after a short time, thus rendering them useless. Besides this, such yarn brakes are of complicated construction, are difficult to adjust, and are also susceptible to disturbance for this reason.

It is accordingly an object of the invention to provide a central connectible yarn brake mechanism which overcomes the hereinaforementioned disadvantages of the heretofore-known devices of this general type, and which creates the following advantages for the doffed threads from the creel; it is safe to operate, it can be easily mounted and it requires no special adjustment work with respect to each other for the fine adjustment of the brake pressure and the position of the brake elements.

With the foregoing and other objects in view there is provided, in accordance with the invention, a central connectible yarn brake mechanism for doffed threads from a creel, including a profiled metal bar having at least one groove formed therein, stationary first brake elements being mutually spaced apart along the metal bar outside the groove and each being associated with one of the threads, first means for individually connecting the first brake elements to the metal bar, movable second brake elements each being associated with one of the threads and being movable between a braking position in which the second brake elements are biased against a thread and against a respective one of the first brake elements and a detached position in which the second brake elements are lifted from a respective one of the first brake elements, bearings disposed on the metal bar in the groove, a central rotatable bar movable in the bearings in the groove, levers each being fastened to the rotatable bar, and second means for individually connecting each of the levers to a respective one of the second brake elements for holding the second brake elements and moving the second brake elements between the braking and detached positions, at least one of the connecting means being an elastically deformable connection element.

The advantages obtained with the invention are especially that through the omission of any joints, there is no apprehension of any break downs due to pollution, the elastic deformation of the connection elements makes a fine adjustment unnecessary, the assembly is simple, all brake locations in the braking position have about the same contact pressure, and sudden closings of the yarn brakes which relay chatter are impossible and therefore damage or undesired thread breakage is avoided. Besides this, the suggested yarn brake mechanism according to the invention can be produced at very propitious costs.

Other features which are considered as characteristic for the invention are set forth in the appended claim.

Although the invention is illustrated and described herein as embodied in a central connectible yarn brake mechanism, it is nevertheless not intended to be limited to the details shown, since various modifications and structural changes may be made therein without departing from the spirit of the invention and within the scope and range of equivalents of the claim.

The construction and method of operation of the invention, however, together with additional objects and advantages thereof will be best understood from the following description of specific embodiments when read in connection with the accompanying drawings, in which:

FIG. 1 is a fragmentary, diagrammatic, cross-sectional view of an embodiment of the central connectible yarn brake mechanism of the invention; and FIG. 2 is a top plan view of FIG. 1.

Referring now to the figures of the drawing as a whole, it is seen that from a creel, which is not represented in its entirety, threads are doffed, and of those, only threads 11, 12 and 13 are visible. The central connectible yarn brake mechanism for these threads, which is only represented in a partial cross-sectional view, is generally designated with reference numeral 14. The yarn brake mechanism 14 is divided into sections. Each section has a vertical erect metal bar section 15. Several such profile bars or sections can be combined to form a frame. The bar section has a C-shaped profile, according to the illustrated embodiment example. In a groove 16 formed in the profile bar 15, in other words inside the profile bar, a central rotatable bar 17 runs in bearings. For this purpose, plates 18 are inserted in spaces formed in the groove 16, and the plates carry friction bearings 19, made of plastic material, in which the bar 17 is carried.

The central displacement of the bar 17 is guaranteed by a moment arm or lever 20, which is fastened at the lower end of the bar 17 and can be actuated by a connecting rod 21. The connecting rod 21 extends along the creel and is connected to a number of levers 20 of the same type for the individual sections. Consequently, all of the bars of a creel or of a creel side can be turned at the same time.

For each of the three threads 11, 12, 13 a stationary first brake element 22 is provided according to FIG. 1. The brake element 22 rests on a holder 24, which is formed of an angular bent sheet and is fastened laterally from the outside to the profile bar 15. The holder 24, has a threading contour 25 at the end thereof on the outside of the brake element 22, which is formed by bending. The thread contour 25 makes the laying-in of the threads easy by using an open yarn brake mechanism. While the yarn brake mechanism is represented in the braking position, a second movable brake element 23 is disposed opposite each stationary brake element 22. The second brake elements have a ski-shape and are connected by an elastic deformable connection element 26 with a two-armed moment arm or lever 27, respectively. The lever 27 has a bushing 28, which is pushed on the bar 17 and is pinned to the bar.

The connection element 26 is formed of rubber blocks. The holders 24 likewise form elastic deformable connection elements, however their elasticity is restricted.

For laying-in the threads, first of all, all of the levers 27 are moved into a detached position 27', which is represented in FIG. 2 with dot-dash lines. As soon as all of the threads of the creel are laid-in, all of the movable brake elements 27 are put in the braking position through a central adjustment. It does not have to be the extreme braking position which is shown in FIGS. 1 and 2. A moderate braking position is enough for starting the winding machine. As soon as a certain doffing or unwinding speed is reached, the yarn brake mechanism and the levers 27 are moved into the detached position 27'. The threads then travel completely free and unhindered through the central connectible yarn brake mechanism from the creel to the winding apparatus.

In the loose or detached position, the movable parts of the yarn brake mechanism cannot disturb the thread path at all. When differently profiled bar sections are to be used, the groove for guiding along the bar is always to be used and therefore all of the advantages based on the invention are carried out.

The invention is not restricted to the illustrated and described embodiment example. Other embodiment examples are also possible.

The elastic deformable connection elements can also be formed of other materials, such as spring elements, or the like. The connecting elements can be fastened at the first brake element, the second brake element or at both brake elements. The form and the material of the brake elements are conformed to the factors concerning the creel operation.

I claim:

1. Central connectible yarn brake mechanism for doffed threads from a creel, comprising a profiled metal bar having at least one groove formed therein, stationary first brake elements being mutually spaced apart along said metal bar outside said groove and each being associated with one of the threads, first means for individually connecting said first brake elements to said metal bar, movable second brake elements each being associated with one of the threads and being movable between a braking position in which said second brake elements are biased against a thread and against a respective one of said first brake elements and a detached position in which said second brake elements are lifted from a respective one of said first brake elements, bearings disposed on said metal bar in said groove, a central rotatable bar movable in said bearings in said groove, levers each being fastened to said rotatable bar, and second means for individually connecting each of said levers to a respective one of said second brake elements for holding said second brake elements and moving said second brake elements between said braking and detached positions, at least one of said connecting means being an elastically deformable connection element.

* * * * *